United States Patent [19]

Epstein

[11] 4,441,219

[45] Apr. 10, 1984

[54] LAVATORY ACCESSORY

[76] Inventor: Harry Epstein, 687 Kildare Crescent, Seaford, N.Y. 11783

[21] Appl. No.: 402,006

[22] Filed: Jul. 26, 1982

[51] Int. Cl.[3] ..... A61H 35/00; E03D 9/08

[52] U.S. Cl. ..... 4/448; 4/420.5; 4/420.4; 4/443

[58] Field of Search ..... 4/448, 447, 443, 445, 4/446, 420.1, 420.2, 420.3, 420.4, 420.5

[56] References Cited

U.S. PATENT DOCUMENTS

| | | | |
|---|---|---|---|
| 2,826,761 | 3/1958 | Lazarus | 4/447 |
| 3,195,148 | 7/1965 | Markel, Jr. | 4/447 |
| 3,430,268 | 3/1969 | Zoberg | 4/420.1 |
| 3,513,487 | 5/1970 | Palermo et al. | 4/420.4 |
| 4,041,553 | 8/1977 | Sussman | 4/447 |
| 4,069,519 | 1/1978 | Alexander | 4/447 |
| 4,195,369 | 4/1980 | Lesick | 4/448 |
| 4,303,339 | 5/1983 | Miller | 4/420.4 |

*Primary Examiner*—Henry K. Artis

*Attorney, Agent, or Firm*—Nolte and Nolte

[57] ABSTRACT

An accessory intended to be added to an existing toilet aids personal hygiene by providing a cleansing jet of either water, or water plus a liquid soap fluid, to provide a cleansing and washing action to a person following use of the toilet. Water plus a medicated fluid may also be provided to relieve discomfort from hemorhoids or other rectal ailments. An outlet head is provided with a venturi tube that draws the liquid soap into the water spray. A valve mechanism is provided to control both the water spray output and the secondary fluid output. In another embodiment, the hygenic cleansing jet is provided and a douche capability is also provided. An additional source of medicated fluid is connected for mixing with the water. In this embodiment, the valve mechanism employs a second internally arranged venturi tube which provides low pressure to draw the medicated fluid into the douche output. The douche embodiment can be further adapted for use as enema.

28 Claims, 7 Drawing Figures

LAVATORY ACCESSORY

BACKGROUND OF THE INVENTION

The present invention relates to an accessory for use with a conventional toilet and, more specifically, relates to an apparatus for washing and promoting personal hygiene following use of the toilet.

The maintenance of personal hygiene is always of utmost importance. Different cultures around the world achieve this in different fashions. One approach to such personal hygiene involves the use of a bidet that provides water to cleanse one's self. While washing with water is both healthful and promotes hygiene, as well as providing a generally comforting and overall soothing feeling, it is not a common practice in the United States. The common practice being the use of a paper product, i.e., toilet tissue. The use of soap and water to wash one's self is far superior to the use of dry paper, both hygienically and economically. Nevertheless, washing with soap and water is not overly popular, and this is due in no small part to the somewhat more complicated method that must now be followed to accomplish this.

In a not unrelated problem, there are numerous sufferers of various rectal and anal ailments, such as hemorrhoids. These persons usually utilize some medication for relief from the symptoms of these ailments. A sitz bath is the most usually recommended and widely accepted treatment of rectal, vaginal, and related disorders, such as hemorrhoids, fissures, and irritations. It has always been an inconvenient and impractical procedure to take a sitz bath in the home.

Similarly, female douching generally involves filling and supporting water bags and the use of costly solutions, or purchasing expensive disposable single-use bottles.

SUMMARY OF THE INVENTION

The present invention provides an accessory for use with existing toilets that provides a cleansing and washing action to the person following use of the toilet. The accessory is attached to the bottom surface of the existing toilet seat and is connected to a source of warm water by means of a flexible, easily installed conduit. A valve is provided to control the on-off operation of the water flow, and a jet provides a stream of warm water.

The present invention also provides a source of secondary fluid that may be mixed with the water, this secondary fluid being a medication, a soap, a lotion or the like. The source of the secondary fluid is connected through a separate on-off valve to the inventive mixing spray head that draws the secondary fluid from its source and adds it to the warm water being expelled by the spray nozzle. This secondary fluid may be perfumed to provide a deodorizing function. When the secondary fluid is not used, the stream of water can be aerated.

The present invention also contemplates the use of an additional accessory for use as a female douche. This embodiment uses a standard douche nozzle, and the fluid may be either plain water or any desired solution drawn from a third fluid source. The inventive apparatus for providing the douche function can be further modified to provide an enema function.

The system of the present invention is intended to be an "add-on" that can be easily installed in a relatively short time using only commonly found hand tools. In one embodiment, the connection to the existing water pipes can be easily made with "saddle" valves and, in another embodiment, the water connection can be made directly to an existing faucet.

Therefore, it is an object of the present invention to provide a lavatory accessory for aiding and improving personal hygiene.

It is another object of the present invention to provide a lavatory accessory having a valved connection to a water supply and a valved connection to a secondary supply of medicated liquid or the like, wherein the two fluids are mixed in a specialized venturi head device.

It is a further object of the present invention to provide a lavatory accessory that may be installed on an existing toilet and is substantially hidden from view.

It is still a further object of the present invention to provide a lavatory accessory having a valved connection to a water supply and a valved connection to a secondary supply of a medicated fluid or the like, wherein the two fluids are mixed for providing a female douche.

It is also on object of the present invention to provide a lavatory accessory having a valved connection to a water supply and a valved connection to a secondary supply of a medicated liquid or the like, wherein the two fluids are mixed for providing an enema function.

The manner in which these and other objects are accomplished by the present invention will be made clear from the following detailed description of the invention.

DETAILED DESCRIPTION OF THE INVENTION

Figure 1:
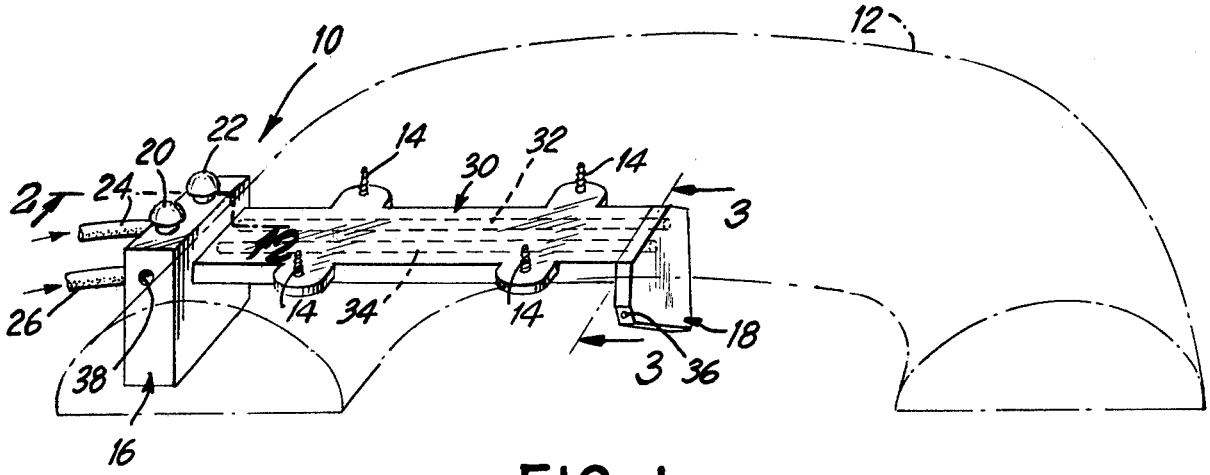
FIG. 1 is a perspective view of the present invention having been installed beneath a conventional toilet seat, a portion of which is shown in phantom.

FIG. 1 shows an embodiment of the present invention 10 arranged in its operable position affixed on the bottom surface of a conventional toilet seat, a portion of which is shown in phantom at 12. The inventive assembly 10 may be affixed to the bottom of the toilet seat by double-backed tape or by a number of screws, shown typically at 14. The control valve assembly 16 of the invention resides outside the perimeter of the seat and the mixing head 18 resides approximately along the centerline of the seat at the rear thereof and in such a fashion as to remain substantially hidden from view. The control valve assembly 16 has two actuating members, the control buttons to which are seen at 20 and 22. The operation of these controls will be explained in detail in relation to FIG. 2, however, at this point it can be stated that these two actuating members control the warm water flow and the secondary or medicated fluid flow. These control buttons 20, 22 are adjustable to control the extent or pressure of the fluid flow. Specifically, connected to the control valve assembly 16 is a warm water line 24, which may comprise conventional flexible polypropylene tubing or the like, that is connected to the body of the valve 16 by means of a brass compression fitting, not shown in FIG. 1. The secondary fluid or medicated fluid is connected to the valve by a similar flexible plastic tubing 26 by pushing the plastic tubing 26 on over a fitting having an enlarged end. This will be seen hereinbelow. The warm water line 24 can be connected through a conventional temperature-controlling mixing valve (not shown) to the hot and cold water lines always available in the typical bathroom. The connections to the hot and cold water lines can be made with commercially available self-piercing saddle valves. In the event a permanent installation is not desired or is not feasible, the water connection may be made directly to the existing faucet by a flexible hose and a diverter valve placed on the end of the faucet.

The spray head 18 is connected to the supply inlets 24 and 26, through the control valve assembly 16, by means of two fluid conduits located inside an elongate element 30. This element 30 has a flat upper surface for easy attachment to the bottom surface of the toilet seat 12. The extent of those fluid conduits will be shown in more detail hereinbelow, however, the actual fluid path is represented in FIG. 1 by dashed lines, specifically, the fluid path for the warm water is represented by dashed line 32, and the fluid path for the secondary fluid is represented by dashed line 34. The present invention also contemplates the substitution of relatively flexible tubing for the elongate element 30. In that embodiment the valve assembly 16 is affixed to the outer periphery of the seat 12 and the spray heat 18 is affixed to the seat 12 independently. The two fluid connections, corresponding to 30, 32, are made by the flexible tubing that can be cut to length, based on the dimensions of the seat 12.

The operation of the control valve assembly 16 is such that after connecting the two fluid-supply lines, 24 and 26, to the appropriate fluid supplies, and depressing button 22 downwardly, warm water is expelled from the head 18, specifically, from outlet jet 36. The head 18 is constructed so that the expelled water will be in a narrow stream. Additionally, means are provided for precisely aiming the stream of fluid so that only a minimal amount of drying is required following use. Upon depressing the button 20 for the secondary fluid actuating member, while the warm water is being expelled, the specialized head 18 causes the secondary fluid to be drawn through fluid path 34 and conduit 26 and mixed with the warm water as it is ejected from the jet 36. The spray head 18 is constructed with an internally arranged venturi tube that creates a low pressure sufficient to draw the secondary fluid through supply conduit 26 and fluid path 34 to the spray head 18. This venturi construction will be shown in detail in FIG. 3. When it is desired to cease spraying the fluids, the opposite ends of buttons 20, 22 are pushed upward to close the valve. Because the flow of warm water through the spray head 18 is necessary for the flow of the secondary fluid, pressing upwardly on the opposite end of button 22 (not shown) will stop all spraying.

If button 22 is depressed, or on, and button 20 is not depressed, or off, the venturi tube in the head 18 will still provide a suction. This is utilized in the present invention to aerate the expelled liquid stream. An aeration aperture 38 is provided in the body 40 of the valve assembly 16 to function in connection with the button 20 for the secondary fluid, that is, when no secondary fluid is being used, air is permitted to enter aperture 38 and aerate the output stream. It is well known that aeration of a fluid will lessen splashing, thereby reducing the amount of drying necessary following use.

Figure 2:
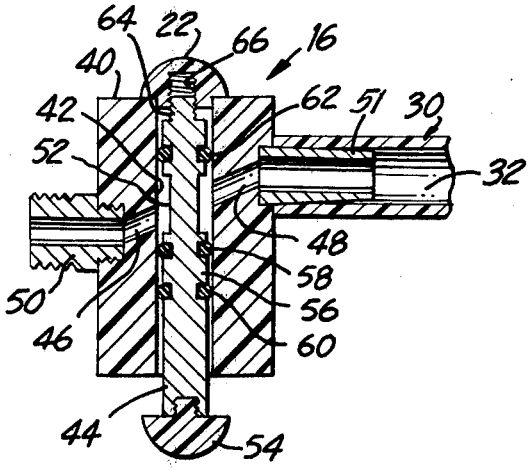
FIG. 2 is a cross-sectional view of the valve assembly of FIG. 1 taken along section lines 2—2.

Referring to FIG. 2, a cross-section of the control valve assembly 16 shows its operable elements in detail. The valve assembly 16 has a valve body 40 formed from a solid block of material, either metal or plastic, or it can be injection molded in two pieces, with the halves ultimately assembled. The valve body 40 has two similar valve bores, one of which is seen at 42. Residing within each valve bore is a slidable valve member. Valve member 44 is slidably arranged in valve bore 42 and has a diameter somewhat smaller than the valve bore 42. Valve bore 42 has an inlet passage 46 and an outlet passage 48, both formed in the valve body 40. The inlet passage 46 is connected to the warm water conduit by a brass fitting 50. The outlet passage 48 is connected to the elongate element 30 and, specifically, to the internal fluid passage 32 therein by a nipple 51. Valve member 44 has a reduced diameter portion 52 that, when aligned between the inlet 46 and outlet 48, places these two passages in fluid communication.

The control of fluid flow through the control valve assembly 16 is accomplished by vertical sliding movement of the valve member 44, which has the reduced diameter portion 52 that interconnects the inlet passage 46 to the outlet passage 48. In the "ON" position, as shown in FIG. 2, the button 22 is threaded onto a threaded portion of the upper end of the slidable valve element 44 in order to control the extent of fluid flow and has been depressed, thereby aligning the reduced diameter portion 52 between the inlet passage 46 and the outlet passage 48. This feeds the warm water to the head 18. When it is desired to stop the flow of the fluid, button 54, which corresponds to button 20 and is located at the other end of valve element 44, is pressed, thereby sliding the valve element 44 upwardly, moving the reduced diameter portion 52 out of alignment between the inlet passage 46 and the outlet passage 48, and breaking the fluid path. In the "OFF" position, with valve element 44 in the up position, a major diameter portion 56 of element 44 is aligned with the inlet passage 46 and is sealed in the bore 42 at that position by O-ring seals 58 and 60. This portion 56 and the O-ring seals, 58 and 60, above and below the inlet 46, effectively prevent any fluid flow. When the valve is in the "ON" position, the two O-ring seals 58 and 60, prevent leakage between the valve element 44 and the lower portion of the bore 42 and a third O-ring seals the upper end of valve element 44 and the upper end of the bore 42.

In the relationship shown in FIG. 2 among the valve element 44, the reduced diameter portion 42, the inlet 46, and the O-ring seals 58, 60, it is possible to adjust the extent or amount of fluid passed through the valve by partially blocking the inlet 46 with the valve element 44, thereby controlling the pressure of the fluid expelled by the jet 36. This can be accomplished by moving the valve element 44 through only part of its possible travel. By adjusting the button 22, which acts as a stop against the top of the valve block 40, in relation to the valve element 44 the extent of travel thereof can be adjusted. Specifically, one end 64 of valve element 44 is externally threaded and button 22 is drilled out and internally tapped, as shown at 66. The length of the threaded end 64 and the depth of the tapped hold 66 are chosen so that enough adjustment is possible to cause a portion of element 44 to partially occlude inlet 46. The fit between the threaded and tapped elements, 64 and 66, can be snug enough so that the parts stay in their adjusted position, or a jam nut or lock nut can be employed to hold the adjustment through repeated operations of the valve element 44.

Figure 3:
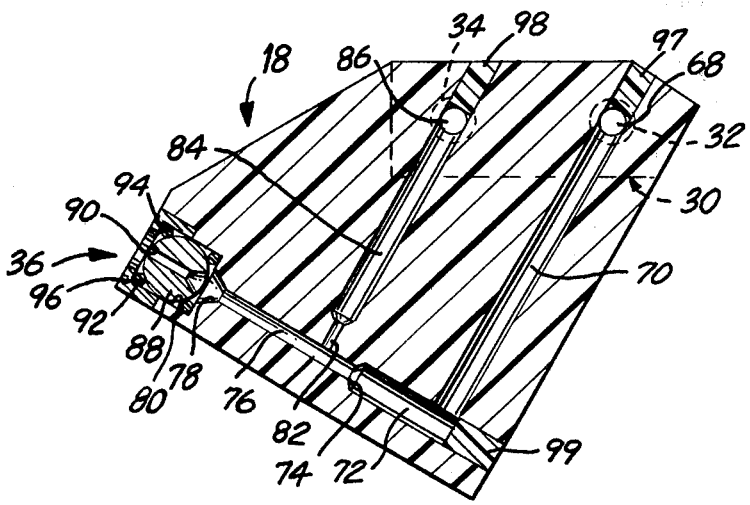
FIG. 3 is a cross-sectional view of the inventive mixing spray head taken along section lines 3—3 of FIG. 1.

FIG. 3 shows the inventive head 18 of FIG. 1 in cross-section taken along lines 3—3 in FIG. 1. The end of the flat dual conduit 30 is connected to the head 18, and the outline thereof is shown by the dashed 30. Similarly, the two fluid conduits, 32 for the warm water and 34 for the secondary fluid, are also shown by dashed lines. The head 18 may be made of any inert rigid material, either metal or plastic. A through aperture 68 connects the warm water conduit 32 with a first fluid passage 70 that turns into a second fluid passage 72. This second fluid passage 72 terminates in a tapered portion, shown typically at 74, which tapers down to a fluid passage section 76 of reduced diameter with respect to fluid passage 70 and 72. The downstream end of this reduced diameter fluid passage section 76 then feeds into a flared portion 78. The flared portion 78 is formed at the upstream end of an exit portion 80 of the fluid conduit and terminates in the outlet jet assembly 36.

The reduced diameter portion 76 of the water flow passage operates as a venturi in the well-known fashion and, thus, produces a low pressure zone at that reduced diameter. As is know, a venturi tube is a short, straight pipe section between two tapered sections. The local pressure varies in the vicinity of this constriction and, by attaching an additional tube to this straight pipe section, it is possible to draw fluids into the main stream. Generally speaking, this is the way in which an internal combustion engine carburetor operates. In the case of the present invention, a short reduced diameter fluid passage 82 is connected to the venturi tube 76, and this leads to a secondary fluid passage 84, which is connected by a through aperture 86 to the secondary fluid conduit 32 formed in the flat dual conduit element 30.

The outlet jet assembly 36 includes a movable ball 88 that has a through passage 90 formed therein. It is through this passage 90 that the outlet stream is expelled. The ball 88 is rotatably mounted so that outlet stream can be directed precisely to the desired location. The ball 88 is mounted to two O-ring seals, 92 and 94, that permit the ball 88 to rotate while providing a fluid-tight seal. The ball 88 can be adjusted through an angle of approximately 15° by inserting a pointed object or wire into the passage 90 and rotating the ball to direct the jet as necessary. The ball 88 and O-rings 92, 94 may be retained in the head by a ring 96 of suitable construction.

FIG. 3 shows one manufacture of the inventive head 18 that is particularly appropriate for prototype or small volume production. In this manufacture, the fluid passages are bored into the main block or element forming the head and then the unused portions of the bores are plugged accordingly. The main fluid passage 70 may be bored from the top and then a plug 97 inserted to seal the end of the passage. Similarly, the main conduit for the secondary fluid flow 84 can also be bored from the top and then plugged with an appropriate plug 98. The passage 72 which has the tapered portion 74 leading into the venturi tube 76 may also be bored from the side and then plugged with a plug 99. In order to provide flared portion 76, this may be also bored from the front with a tapered tool after first boring out the venturi passage 76. The preferred manufacture of head 18 would involve injection molding the head in two pieces with all passages fully formed and then assemblying the two halves.

In operation, upon depressing the warm water control button 22 water flows into and through the valve assembly 16, through the water conduit 34, and flows through aperture 68, down passages 70 and 72 through the venturi tube 76 and is expelled at the jet 36. The passage of water through the venturi tube 76 causes a pressure drop in the reduced diameter tube section 82 and, thus, in the secondary fluid passage 84. This low pressure zone proceeds through aperture 86 to secondary fluid conduit 32 so that, when the secondary fluid button 20 is depressed, atmospheric pressure will force the secondary fluid from the secondary fluid conduit 32 to the low-pressure zone. The continuing low pressure from the venturi tube 76 will cause the secondary fluid and the warm water to be mixed therein and ultimately expelled together through the jet assembly 36.

Figure 4:
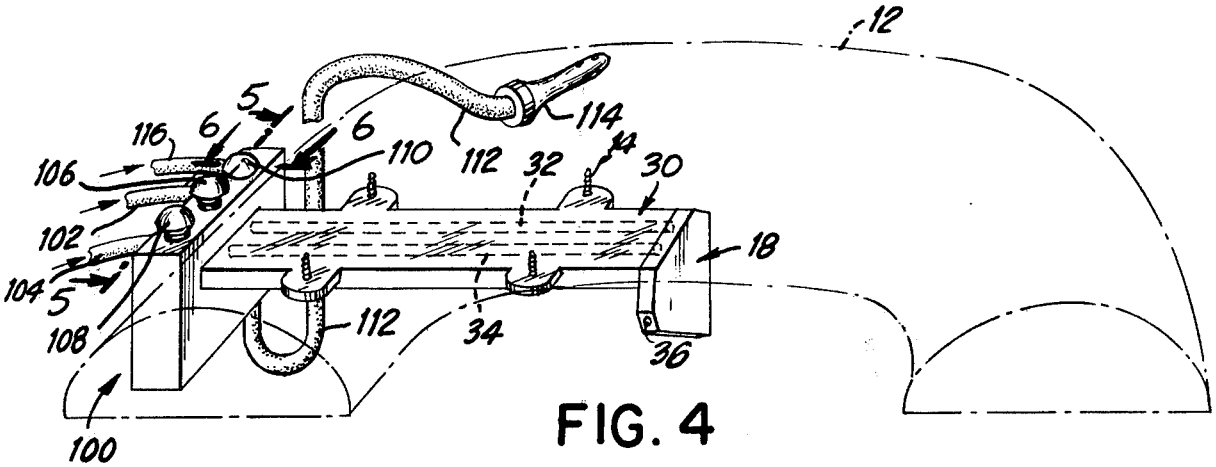
FIG. 4 is a perspective view of an embodiment of the control valve assembly of the present invention having means for use as a douche.

FIG. 4 shows another embodiment of the present invention that has an additional hygenic function. Specifically, in addition to the warm water flow and secondary fluid source, this embodiment provides a douche capability. Specifically, warm water is fed into a control valve assembly 100 on line 102 as in the previous embodiment, and a secondary source, such as medicated fluid or the like, is connected on line 104. These two fluids function with the fluid control elements operated by buttons 106 and 108, respectively, in the fashion that the embodiment shown in FIGS. 1, 2, and 3 operates. Again, the buttons utilize means for adjusting the output fluid pressure. Briefly stated, by depressing both buttons 106 and 108, a mixture of warm water and a fluid from the secondary source (not shown) is expelled by the venturi head 18. In the embodiment of FIG. 4, an additional control element is provided and has associated with it button 110. This control element directs the flow of warm water from conduit 102 to a hose 112 to which is attached a standard douche bone 114. Additionally, a tertiary source of fluid (not shown) is connected by a conduit 116 to the valve assembly 100. The valve assembly 100 is provided with an internal venturi tube so that the medicated fluid in the tertiary source is mixed with the water expelled at the douche bone 114.

Thus, in operation of the embodiment of FIG. 4, assuming all control buttons 106, 108, 110 are in the up or off position, button 110 is depressed and the warm water from conduit 102 is expelled through the douche bone 114. If a tertiary fluid supply is connected to conduit 116, the action of a venturi tube in the control valve assembly 100 will cause this fluid to be mixed with the warm water at the venturi tube and the mixture expelled at the douche bone 114.

The present invention also provides the capability to function as an enema. This can be achieved by substituting an enema nozzle (not shown) for the douche bone 114. This is easily accomplished by a threaded fitting (not shown) at the end of hose 112.

Figure 5:
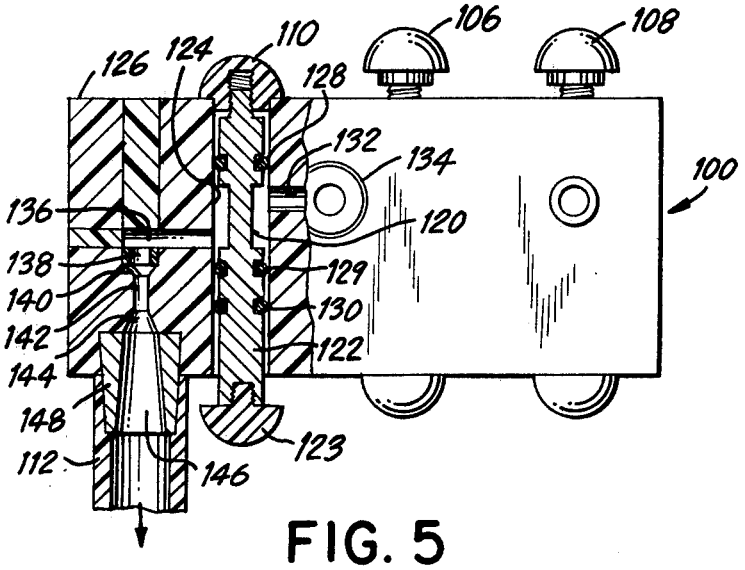
FIG. 5 is a cross-sectional view of the valve assembly of FIG. 4 taken along section lines 5—5.

Referring to FIG. 5, the control valve assembly 100 is shown in partial cross section. Specifically, the cross-section is taken through the portion of the control valve assembly 100 that controls the additional douching functions. As indicated, buttons 106 and 108 and their corresponding valve elements function in this embodiment exactly as did these elements in the embodiment described in FIGS. 1, 2, and 3. In FIG. 5, buttons 106 and 108 are represented in their off or unactuated position and, thus, no fluids can be expelled from the head 18. Button 110 has been depressed and, thus, warm water from the conduit 102 is flowing through the hose 112. All buttons involve the threaded connections with the slidable valve elements to permit adjustment of fluid pressure. Hose 112 and conduit 102 are connected via control valve assembly 100 and, specifically, through a reduced diameter portion 120 formed in a slidable valving element 122. Valving element 122 is substantially identical to the other valving elements, i.e., it is a cylindrical element having a control button 110, 123 at either end and the reduced diameter portion 102. Valving element 122 is sealed in a fluid-tight manner in bore 124 formed in the main valve block 126 by three O-rings 128, 129, and 130, in the same manner as the assembly of FIG. 2. The main water inlet in the control valve assembly 100 is seen in part at 132 and is connected to the warm water conduit 102 by a threaded brass compression fitting 134. The reduced diameter portion 120 in the slidable valve member 122 can be aligned between inlet passage 132 and a fluid conduit passage 136, which leads to a reduced diameter fluid passage 138 having a tapered portion 140 feeding into a reduced diameter section 142 that acts as a venturi tube. The exit of the venturi tube 142 is a flared portion 144. The fluid then flows into a main fluid channel 146 and out into the hose 112.

Hose 112 is connected to the control valve assembly 100 by a tapered connector 148. This tapered connector 148 has a three degree taper to facilitate attachment of hose 112. The inner bore of connector 148 is not straight but is flared outwardly as a continuation of flared portion 144, thereby completing the flared section needed for the venturi tube 142 to function. The venturi tube 142 provides a lower pressure relative to atmospheric when the water is flowing therethrough, under the control of valve element 122, and this draws in fluid from the tertiary source on tube 116, shown in FIG. 6.

Figure 6:
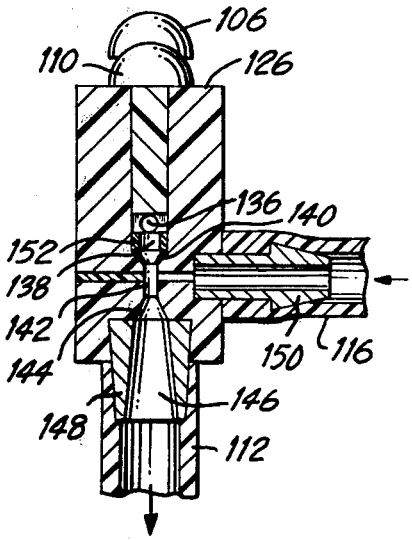
FIG. 6 is a cross-sectional view of the valve assembly of FIG. 4 taken along section lines 6—6 and FIG. 7 is a perspective view, in exploded form, of a bracket and bottle assembly forming part of the present invention.
Figure 7:
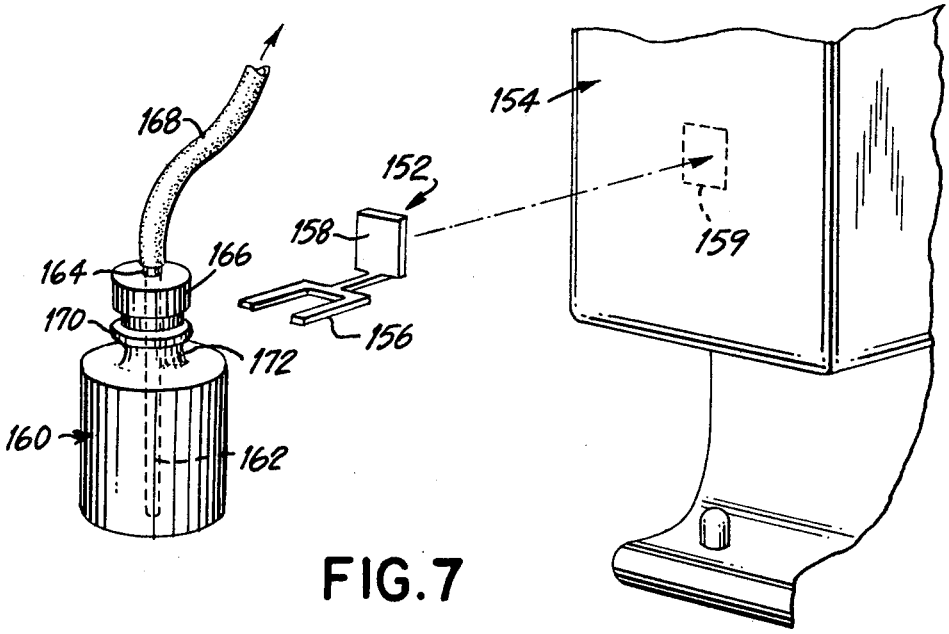

Referring to FIG. 6, a cross section is taken along lines 6—6 of FIG. 4 in order to show internally the control valve assembly 100. The venturi tube 142 is shown in FIG. 6., as is the outlet connector 148, and an inlet connector 150, to which the tertiary fluid supply line 116 is connected. The fluid conduit passage 136 appears as an aperture upon looking into the bore of the passage and this feeds the reduced diameter fluid passage 138 and the tapered portion 140. As in the embodiment shown with respect to the spray head of FIG. 3, then the preferred mass production technique would involve injection molding the valve body in two pieces and then assembling the halves. The construction as shown in FIG. 6 is appropriate for a prototype, wherein the venturi tube may be had by boring holes in the block of material forming the body 126 of the valve assembly 100 and then subsequently providing plugs to seal off the portion of the bore not utilized. In that regard, the chamber 138 is reduced in diameter by means of a tube 152 inserted into the original bore.

In operation of the embodiment of FIGS. 4, 5, and 6, the control buttons 106 and 108 are placed in their off position and control button 110 is placed in its on position, thereby permitting warm water to flow from conduit 102 through the inlet passage 132 and the interconnecting passage 120 in valve member 122, through passages 136 and 138, through venturi tube 142 and out into hose 112. Because the venturi tube 142 causes a low pressure in the vicinity of the reduced diameter, atmospheric pressure forces liquid from the tertiary fluid supply (not shown) through tube 116 to mix with the warm water in the valve body and be fed out in hose 112.

What I claim is:

1. A lavatory accessory for use with a toilet having a seat, a bowl, and a water source, comprising:

a secondary fluid source;

a manually operable fluid valve means having a first inlet and outlet corresponding to the water source and a second inlet and outlet corresponding to said secondary fluid source;

first and second fluid conduit means connecting the water source and said secondary fluid source to the corresponding first and second inlets of said valve means;

head means having a water inlet and a secondary fluid inlet both connected through internally arranged fluid passages to an outlet jet formed therein;

third and fourth conduit means connecting said first and second outlets of said valve means to the corresponding inlets of said head means; and said fluid passages in said head means including a venturi tube between said water inlet and said outlet jet, for forming a low pressure zone thereat upon passage of water therethrough, said fluid passages further including a passage connecting said secondary fluid inlet in said head means to said venturi tube, whereby secondary fluid is drawn from said secondary fluid source, mixed with the water and expelled from said outlet jet.

2. The lavatory accessory of claim 1, wherein said third and fourth conduit means comprise a rigid elongate unitary element having internally arranged first and second fluid paths and formed having at least one planar surface.

3. The lavatory accessory of claim 2, further comprising means for attaching said rigid elongate unitary element to the toilet seat, whereby said at least one planar surface is adjacent the bottom surface of the toilet seat, said elongate unitary element being of a length such that said head means is centrally located at the rear of the opening in the seat.

4. The lavatory accessory of claim 2, wherein said valve means is rigidly attached to one end of said rigid elongate unitary element and said spray head means is rigidly attached to the other end of said rigid elongate unitary element.

5. The lavatory accessory of claim 1, further comprising means for attaching said manually operable fluid valve means to the bottom surface of the seat and arranged at the periphery thereof and means for attaching said head means to the bottom surface of the seat and arranged so that said head means is centrally located at the rear thereof.

6. The lavatory accessory of claim 1, wherein said valve means includes first and second manually operable valve elements slidably arranged in a valve body and being selectively operable to connect said water inlet to the corresponding outlet and said secondary fluid inlet to the corresponding outlet.

7. The lavatory accessory of claim 1, wherein said secondary fluid source comprises a bottle having a flange at the neck thereof and further comprising secondary source support means having a planar surface for mounting said support means on a vertical surface and a bifurcated element cooperating with said flange of said bottle, whereby upon mounting said support means on said vertical surface, the neck of the bottle is placed in the bifurcated element and supported by the flange.

8. The lavatory accessory of claim 1, wherein said outlet jet comprises a movable ball having a through passage in fluid communication with the outlet of said venturi tube and being sealingly arranged in said head means.

9. The lavatory accessory of claim 8, wherein said movable ball is sealingly arranged in said head means by rubber O-rings.

10. The lavatory accessory of claim 8, wherein said through passage in said movable ball is dimensioned so that said movable ball can be rotated at least 15° and remain in fluid communication with the outlet of said venturi tube.

11. Apparatus for use with a toilet seat having a bowl and a seat, comprising:

head means having first and second inlets in fluid communication with an outlet jet;

a source of water under pressure;

a source of a second fluid;

fluid conduit means connecting said water source to said first inlet and said head means and said second fluid source to said second fluid inlet of said head means; and said head means including an internally arranged venturi tube means in the fluid path between said first inlet and said outlet jet for creating a low-pressure zone thereat when water flows through said venturi tube means, and a fluid passage connecting said second inlet to said low pressure zone at said venturi tube means, whereby said water and said second fluid are mixed and expelled from said outlet jet in said head means.

12. The apparatus of claim 11, further comprising manually operable valve means having first and second inlets connected to said water source and said source of a second fluid and corresponding first and second outlets connected between said fluid conduit means and said source of water and said source of a second fluid.

13. The apparatus of claim 11, wherein said conduit means comprises a rigid element having at least one flat surface and including means for attaching said conduit means to the toilet seat with said flat surface adjacent the bottom surface of the toilet seat.

14. The apparatus of claim 11, wherein said source of a second fluid comprises a bottle having a flange at the neck thereof, and further comprising support means having at least one planar surface for mounting said support means on a substantially vertical surface and a forked element cooperating with said flange of said bottle, whereby upon mounting said support means on said vertical surface, the neck of the bottle is placed in the forked element and supported by the flange.

15. The apparatus of claim 11, wherein said outlet jet comprises a movable ball having a through passage in fluid communication with the outlet of said venturi tube and being sealingly arranged in said head means.

16. The apparatus of claim 15, wherein said movable ball is sealingly arranged in said head means by rubber O-rings.

17. The apparatus of claim 8, wherein said through passage in said movable ball is dimensioned so that said movable ball can be rotated at least 15° and remain in fluid communication with the outlet of said venturi tube.

18. Apparatus for use with a toilet having a seat and bowl, and a source of water under pressure, comprising;

valving and mixing means having a first inlet connected to the water source and a second inlet connected to a first source of medicated fluid and having first and second fluid outlets said first inlet connected through first and second internal fluid passages to said first and second fluid outlets and said second inlet connected through a third fluid passage to said second fluid passage;

a first fluid output means connected to said first fluid outlet of said valving and mixing means and including means for arranging said first fluid output means on the bottom surface of the seat and to the rear of the opening therein;

a second fluid output means connected through a flexible fluid conduit to said second fluid outlet of said valving and mixing means; and said valving and mixing means having a first manually operable valve means for controlling the flow of water out of said first fluid output means, a second operable valve means for independently controlling the flow of water out of said second fluid output means, said second internal fluid passage including a venturi tube through which the pressurized water flows, thereby creating a localized low-pressure zone, and said third fluid passage connected to said venturi tube, whereby said secondary fluid is drawn into and mixed with the water in said second fluid passage in said valving and mixing means and is expelled through said second fluid output means.

19. The apparatus of claim 18, further comprising:

a second source of medicated fluid connected to a third input of said valving and mixing means;

said valving and mixing means having a third fluid outlet corresponding to said third input and having a third operable valve means for controlling the output of said third fluid outlet;

said first output means having a second inlet connected to said third fluid outlet and said first and second inlets being connected by internal fluid passages, said first output means internal fluid passages including a second venturi tube through which the water flows for forming a low pressure zone thereat, said second inlet is connected by a fourth internal fluid passage to said second venturi tube, whereby fluid from said second source is drawn through said third inlet of said valving and mixing means and is expelled from said first fluid output means.

20. The apparatus of claim 19, wherein said valving and mixing means further includes a third manually operable valve means for controlling the flow of fluid from said third fluid outlet.

21. The apparatus of claim 18, wherein said second fluid output means comprises a douche bone.

22. The apparatus of claim 18, wherein said second fluid output means comprises an enema nozzle.

23. The apparatus of claim 18, wherein said means for arranging said first fluid output means includes a flat elongate rigid element connected to said first fluid output means and said valving and mixing means and further including internal fluid conduit for making the fluid connection therebetween.

24. The apparatus of claim 18, wherein said first source of medicated fluid comprises a bottle having a flange at the neck thereof and further comprising support means having a planar surface for mounting said support means on a substantially vertical surface and a bifurcated element cooperating with said flange on said bottle, whereby said bottle is supported.

25. The apparatus of claim 19, wherein said second source of medicated fluid comprises a bottle having a flange at the neck thereof, and further comprising support means having a planar surface for mounting said support means on a substantially vertical surface and a bifurcated element cooperating with said flange on said bottle, whereby said bottle is supported.

26. The apparatus of claim 19, wherein said first output means further comprises an outlet jet for expelling fluid and includes a movable ball having a through passage in fluid communication with the outlet of said venturi tube and being sealingly arranged in said first output means.

27. The apparatus of claim 26, wherein said movable ball is sealingly arranged in said first output means by rubber O-rings.

28. The apparatus of claim 26, wherein said through passage in said movable ball is dimensioned so that said movable ball can be rotated at least 15° and remain in fluid communication with the outlet of said venturi tube.

* * * * *